US005314355A

United States Patent [19]

Halvonik

[11] Patent Number: 5,314,355

[45] Date of Patent: May 24, 1994

[54] COPLAINER SLIDING ELECTRICAL CONNECTOR

[75] Inventor: Mark R. Halvonik, Rochester, N.Y.

[73] Assignee: Xerox Corporation, Stamford, Conn.

[21] Appl. No.: 891,085

[22] Filed: Jun. 1, 1992

[51] Int. Cl.[5] ..... H01R 25/00

[52] U.S. Cl. ..... 439/638; 439/752

[58] Field of Search ..... 439/638, 639, 640, 650–655, 439/686–689, 701, 733, 741, 742, 752, 731

[56] References Cited

U.S. PATENT DOCUMENTS

| | | | |
|---|---|---|---|
| 3,297,886 | 1/1967 | Danner | 439/654 |
| 3,324,447 | 6/1967 | Pistey | 439/441 |
| 3,474,380 | 10/1969 | Miller | 339/17 |
| 3,569,917 | 3/1971 | Petrus | 339/198 |
| 4,154,499 | 5/1979 | Weber | 439/654 |
| 4,168,879 | 9/1979 | Ohtsuki et al. | 339/258 |
| 4,500,160 | 2/1985 | Bertsch | 439/701 |

*Primary Examiner*—David L. Pirlot

[57] ABSTRACT

An electrical connector assembly having a front and a back side has an electrically insulating connector housing having a front side and a back side and at least one aperture extending from the front side to the back side, an electrically conductive unitary spring clip connector extending from the front side of the housing through the aperture to the back side of the housing, the spring clip connector having a connecting terminal on one end and a resiliently deflectable spring contact on the other end and an insulating retention plate to retain the spring clip connector in the housing, the retention plate being fastened to and on the back side of the connector housing and having at least one aperture therein with the connecting terminal on one end of the spring clip connector extending therethrough.

19 Claims, 6 Drawing Sheets

COPLAINER SLIDING ELECTRICAL CONNECTOR

BACKGROUND OF THE INVENTION

The present invention relates to electrical connectors and in particular to a versatile simple inexpensive reliable electrical interface which enables electrical contact in two directions perpendicular to each other.

There are many machines in use today wherein a functional module is inserted and withdrawn from the main machine frame. For example, in electrostatographic printing apparatus it is common to have various of the subsystems in the imaging machine be removably mounted in the machine. Accordingly, the individual modules such as, for example, a developer housing or a cleaner housing may be mounted such that it is removably inserted in the machine and can be withdrawn for replenishment, repair, etc. In such applications, typically the developer housing, for example, has to be positioned very close to, if not in contact with the photoreceptor to enable adequate development of the electrostatic latent image formed on the photoreceptor. To minimize damage to the delicate photoreceptor, the developer module is inserted on a track or rail type of arrangement which spaces it slightly from the photoreceptor until it reaches its end position where it is moved into developing engagement with the photoreceptor by being moved in a direction perpendicular to the insertion direction into the main machine. Upon insertion, electrical contact between the developer housing, for example, and the main machine must be made to provide operational power to the developer housing as well as signal level control.

It has previously been proposed to provide an electrical connector assembly attached to a module, such as a developer housing, at one end which contacts an electrical power source on the main machine through the use of a spring clip contact in a plastic housing. While the one end of the electrical connector may take the form of a spring clip having a large contact area, typically the other end of the electrical connector is connected to a wire on the module or developer housing by means of a screw, weld or other type of physical connector. In addition, typically the wires connected to such a connector come out the sides of the connectors assembly which constrains the positioning of the connector assembly to the module and more importantly, if the connections are made on both sides of the connector housing, one of the connections must be substantially modified to enable the spring clips to face in the same direction to enable the lateral positioning. Typically, this geometry then requires additional parts and manufacturing operations to provide such a connector.

SUMMARY OF THE INVENTION

In a principle aspect of the present invention a space efficient, low part count, easy to assemble, low cost, spring loaded electrical make break connector for a module, which is insertable into a machine and permits lateral motion to the home position after insertion is provided.

In a principle aspect of the present invention the electrical connector assembly has a front and a back side and comprises an electrically insulating connector housing having a front side and a back side with at least one aperture therein extending from the front side to the back side, an electrically conductive unitary spring clip connector extending from the front side of the housing through the aperture to the back side of the housing and having a connecting terminal on one end and a resiliently deflectable spring contact on the other end and an insulating retention plate to retain the spring clip connector in the housing which is fastened to and on the back side of the connector housing and has at least one aperture therein with the connecting terminal on one end of the spring clip connector extending therethrough.

In a further aspect of the present invention the connector assembly includes a mating and locating feature comprising at least one mounting pin adjacent the said at least one aperture in the housing, a mounting hole in the spring clip connector and at least one retention hole in the retention plate, the spring clip connector being mounted on the mounting pin through the mounting hole and the retention plate being mounted on the top of the spring clip on the mounting pin.

In a further aspect of the present invention the connecting terminal on the spring clip connector is a male quick connect/disconnect connector having a raised dimple for cooperative engagement with a female quick connect/disconnect connector.

In a further aspect of the present invention the spring clip connector is generally U-shaped with the spring contact being one arm of the U and the mounting hole being in the arm of the U and having at its end a downwardly inclined arm with a male quick connect/disconnect connector at the end.

In a further aspect of the present invention the spring clip connector is stainless steel and has a thickness of about 0.2 mm.

In a further aspect of the present invention there are a plurality of apertures in the housing having cooperatively associated therewith unitary spring clip connectors and apertures in the retention plate to form a plurality of electrical connectors on the front and back sides.

In a further aspect of the present invention the connector assembly has a plurality of electrical connectors in the front and back sides, which are electrically insulated from each other.

In a further aspect of the present invention the plurality of electrical connectors are in a matrix pattern and the connector housing and retention plate are molded insulating plastic and the housing has insulating ribs integrally molded on its front side, separating and electrically isolating adjacent connectors whereby the spring contacts are located in insulating cavities.

For a better understanding of the present invention, attention is now directed to the drawings.

DETAILED DESCRIPTION OF THE INVENTION

As will be apparent from the drawings and the following description, the present invention has only three essential elements, a connector housing, a spring clip connector and a retention plate. While illustrated as providing a matrix pattern of a plurality of individual connectors it will be understood that the connectors may be placed in any desired pattern and that only a single spring clip connector need be used per cavity.

Figure 1:
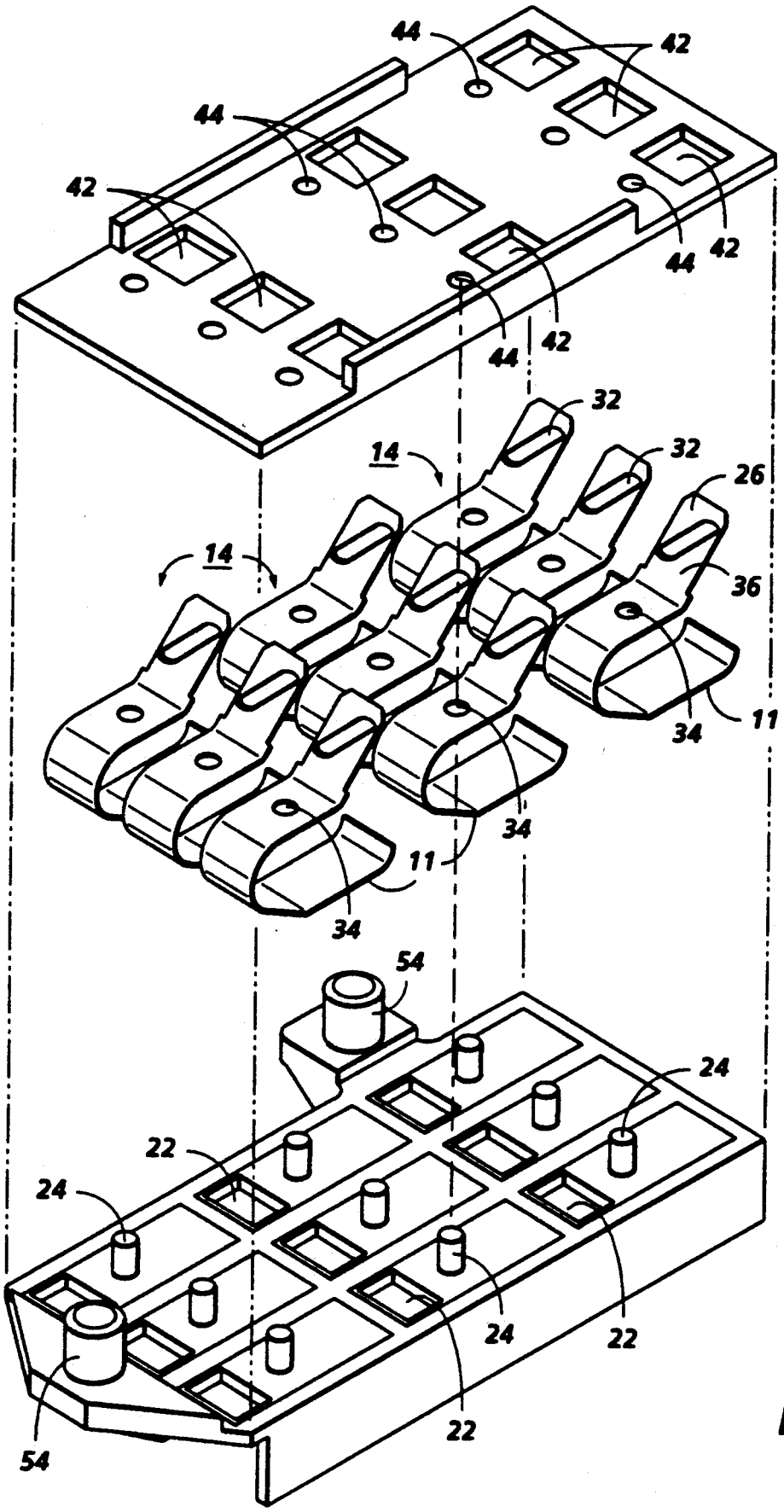
FIG. 1 is an exploded isometric view of the electrical connector assembly according to the present invention.
Figure 2A:
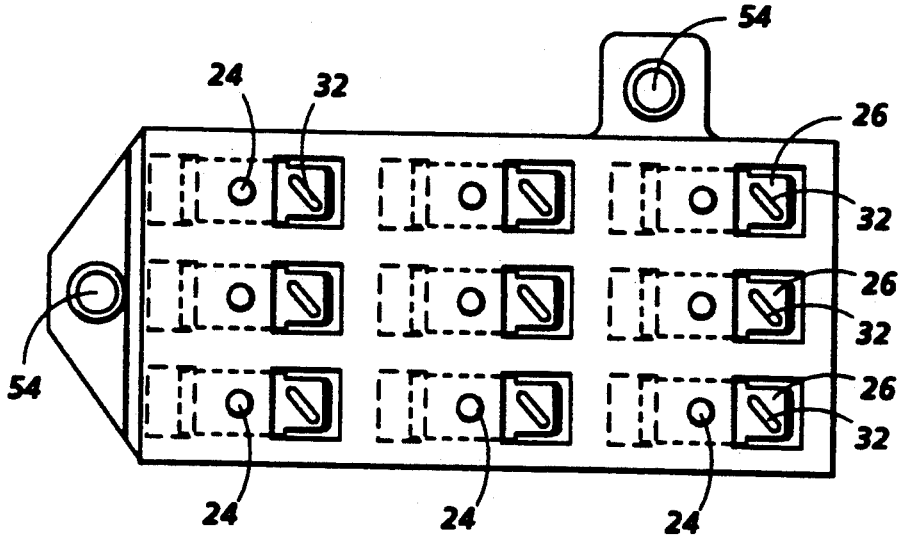
FIGS. 2*a* and 2*b* are back and front views respectively of the assembled connector.
Figure 2B:
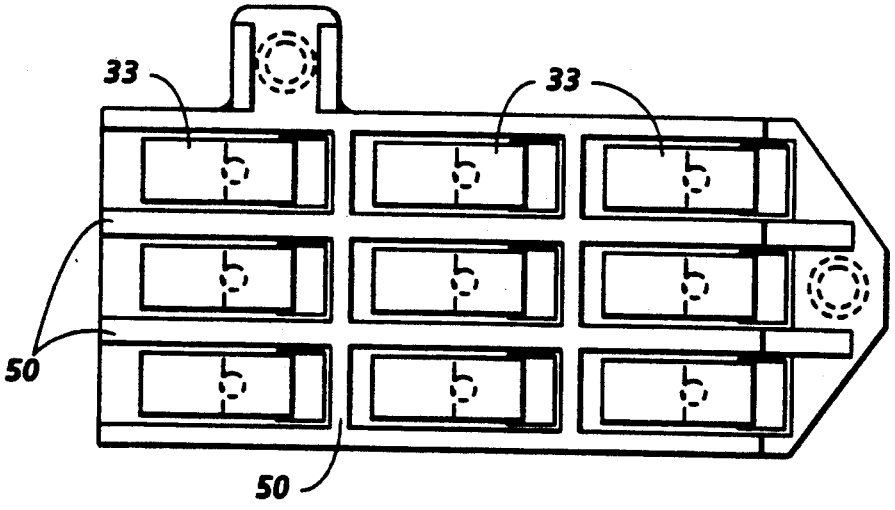
Figure 4A:
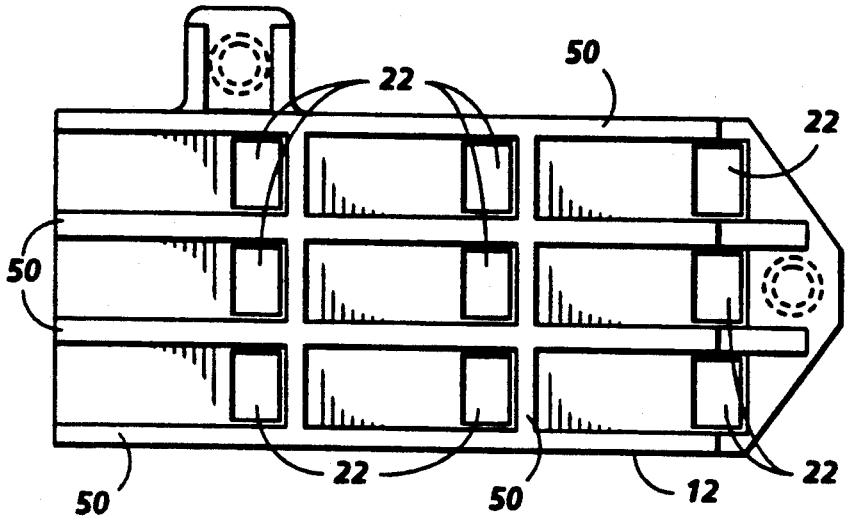
FIGS. 4*a* and 4*b* are front and back views respectively of the connector housing.
Figure 4B:
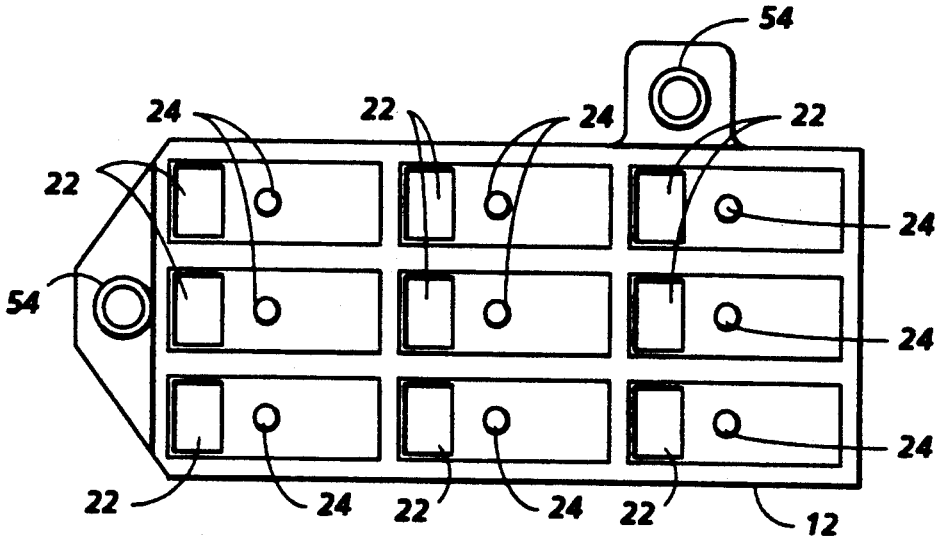
Figure 5A:
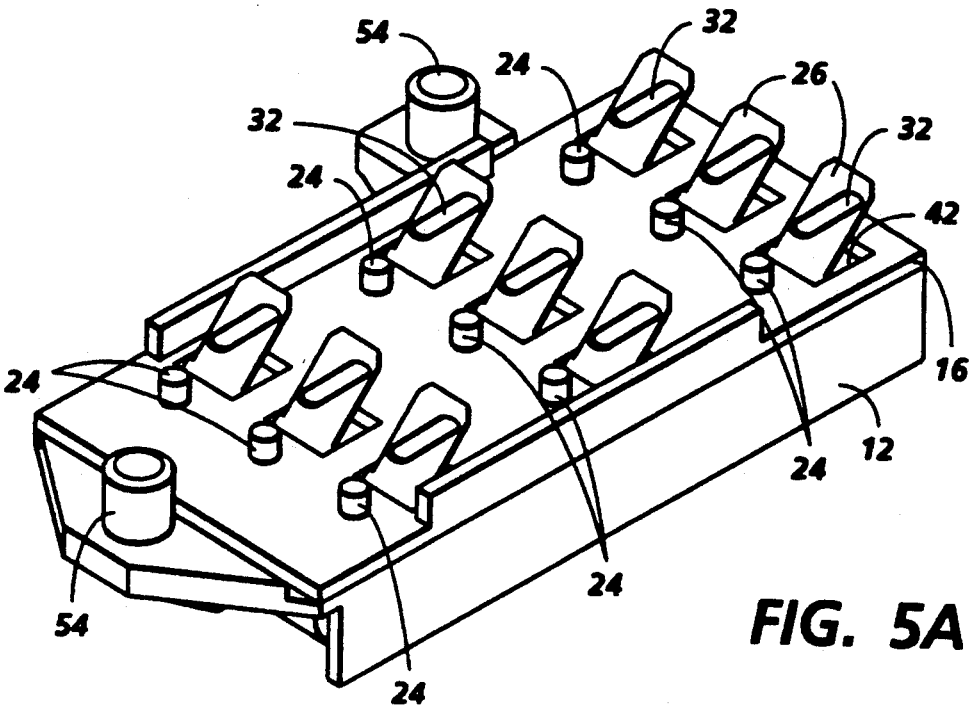
FIGS. 5*a* and 5*b* are isometric views of the electrical connector assembly showing the back and front sides respectively.
Figure 5B:
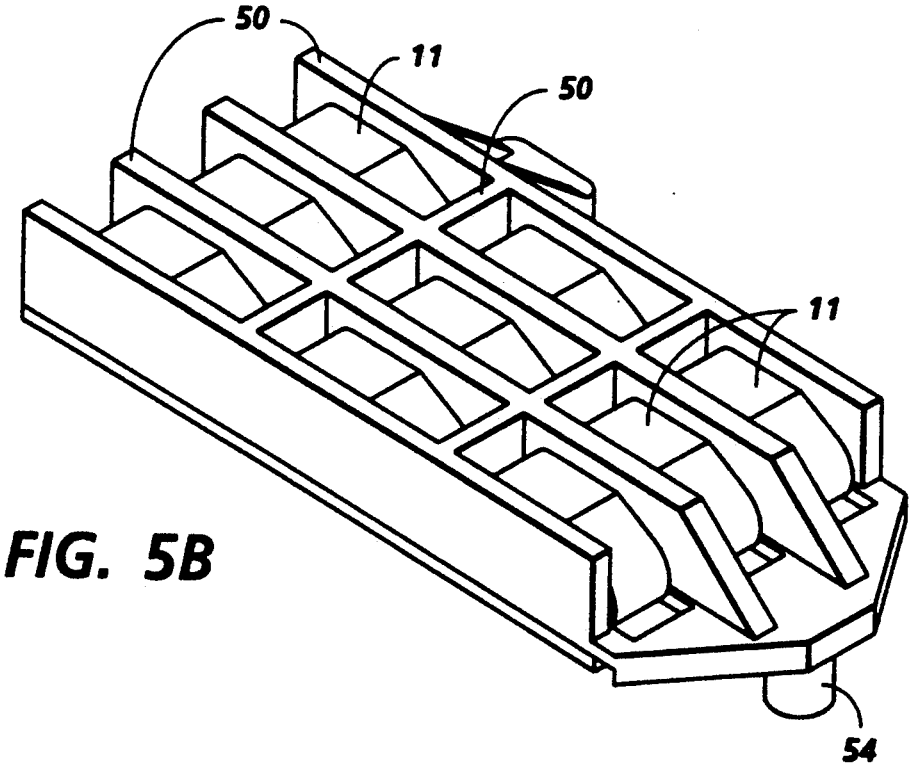

Referring now to the exploded isometric view of FIG. 1, as well as the assembled views of FIGS. 2*a* and 2*b* it will be observed that the electrical connector assembly 10 provides a total of nine electrical contacts 11. Turning now to FIGS. 4*a* and 4*b*, which represent the top view and bottom view of the connector housing, a plurality of apertures 22 extending from the back of the housing through the housing to the front of the housing are provided. Associated with each of these apertures is a mounting pin 24 which is used for mounting the electrical spring clip connector 14 and the retention plate 16 as will be herein after discussed. The connector housing is typically made from a molded plastic such as ABS and provides a matrix pattern for the individual connectors which are separated by insulating ribs 50 (See FIG. 5*a*) and thereby provide insulating cavities 52 on the front of the connector assembly for the spring contact of the spring clip connector. To facilitate lateral movement of the electrical connector assembly when it is positioned in the machine these spring clip connectors 14 in the individual insulating cavities 52 are oriented in the same direction in the connector housing which may have a tapered or inclined portion at the leading end which is being laterally moved.

Figure 3A:
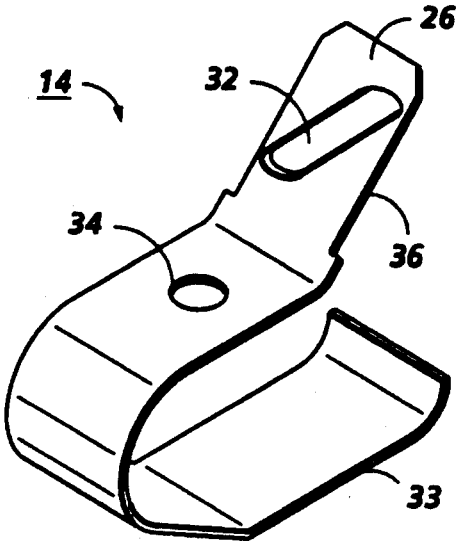
FIGS. 3*a* and 3*b* are isometric views of the electrically conductive unitary spring connector.
Figure 3B:
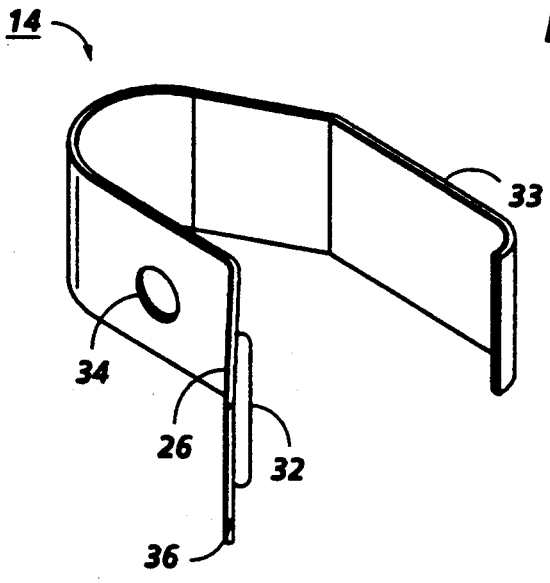

Turning now to FIGS. 3*a* and 3*b*, the electrically conductive unitary spring clip connector 14 is illustrated as being generally U-shaped in construction with the spring contact being one arm 33 of the U and the mounting hole being in the other arm of the U and having at its end an upwardly inclined arm 36 which provides the other connecting terminal. The upwardly inclined arm 36 has a raised dimple 32 with rounded end that provides the male portion of a quick connect/disconnect connector. By the term "quick connect/disconnect connector" it is intended to define a two piece electrical connection comprising a male portion and a female portion which may be quickly and easily joined to complete an electrical connection and just as quickly and easily separated to break the electrical connection. An example of such a connector is the "fast on" connector available from AMP Inc. of Harrisburgh, Pa. The dimple increases the overall thickness of the connecting terminal so that it can be used with a standard female quick connect/disconnect connector enabling the appropriate interference with the female terminal. The unitary spring clip connector 14 is made of a conductive resiliently deflectable material to provide electrical contact with a pin contact on the main machine upon insertion and lateral movement into position. Typically, it is made from stainless steel and has a thickness of about 0.2 mm to provide the desired spring function as well as to enable formation of a dimple to provide a thickness to enable cooperation with a standard female quick connect/disconnect connector. The mounting holes 34 are used to locate and mount the unitary spring clip connector 14 on the mounting pins 24 in the connector housing 12 so that the spring contacts are positioned in the insulating cavities 52 at the front of the connector housing.

As may be observed the retention plate 16 has a plurality of apertures 42 through which the unitary spring clip connector 14 is inserted to provide the connecting terminal 26, which is engageable with the female portion of the quick connect/disconnect connector, on the back of the connector assembly. Associated with each of the apertures 42 are retention holes 44 which engage the mounting pins 24 in the connector housing 12.

Figure 6:
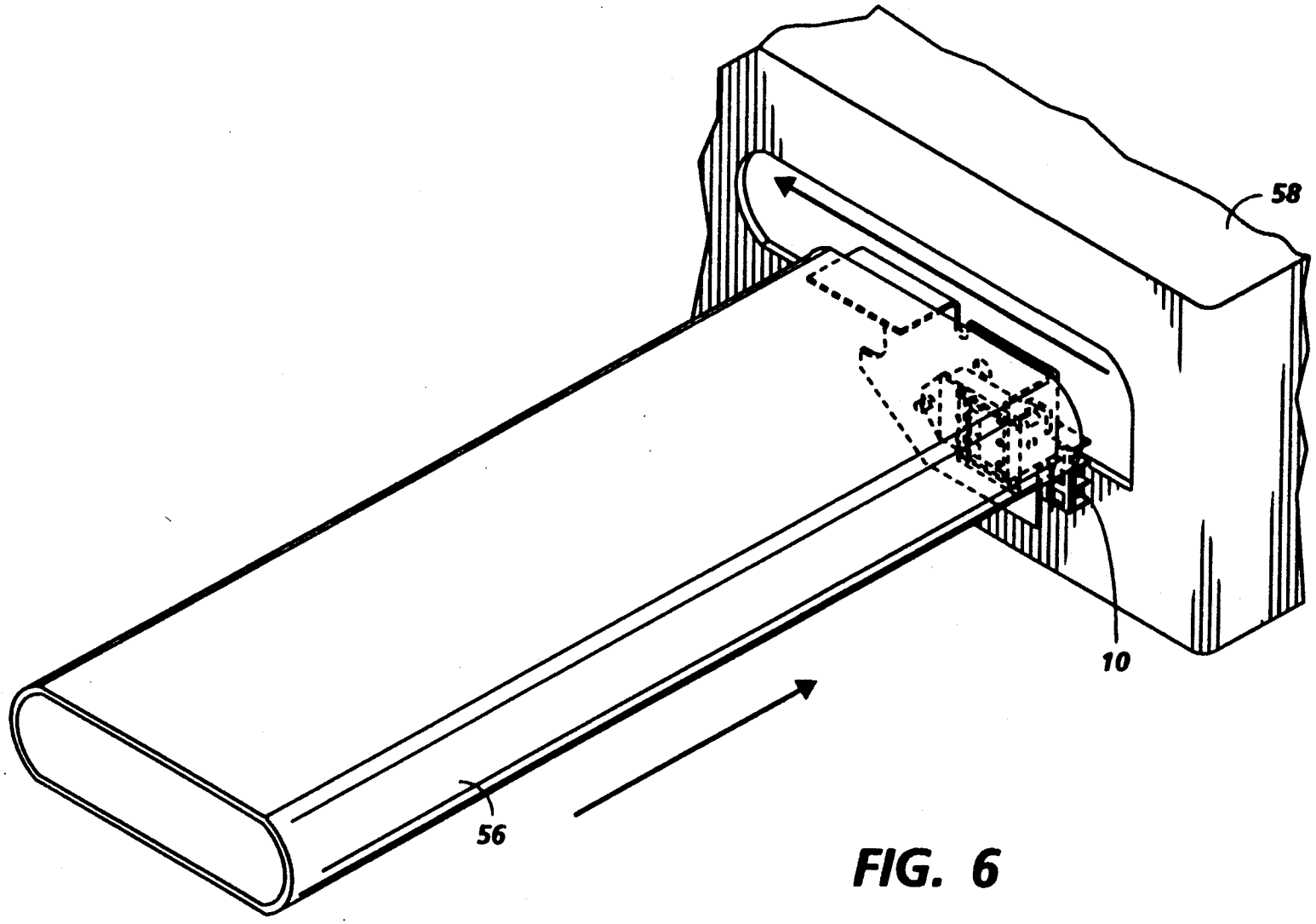
FIG. 6 is a representation of a module such as a developer housing being inserted in the side of a machine such as an electrostatographic printing machine and after insertion, moved into operational relationship with the photoreceptor in a lateral direction.

The connector assembly 10, according to the present invention is capable of robotic top down assembly wherein the unitary spring clip connectors 14 are readily inserted into the apertures 22 in the connector housing while at the same time having their mounting holes 34 placed over the mounting pins 24 in the connector housing 12. Subsequently, the retention plate 16 may be placed on the connector housing 12 having the unitary spring clips 14 so that the spring clips extend through the apertures 42 in the retention plate 16 and the retention holes 44 in the retention plate engage the mounting pins 24 on the connector housing. The retention plate may be fixed to the connector housing by any suitable means such as with an adhesive or by heat staking or spin welding the retention plate to the connector housing. FIGS. 2*a* and 2*b* illustrate the back and the front sides of the assembled connector assembly. Also illustrated are external mounting posts 54 to enable the mounting of the connector assembly to a frame or module which is going to be inserted into the main machine. In use, the male connecting terminals 26 on the connector assembly would be connected to female terminals on the module and then the connector assembly connected by means of the mounting posts directly to the end of a module. With reference to FIG. 6 the electrical connector assembly 10 is mounted on the end of the developer module 56 which can then be inserted into the main machine 58 such as an electrostatographic printing machine and once at the end of its insertion path make electrical contact with electrical pin contacts on the main body of the machine and/or the module can be rotated or otherwise moved into its operational position to further complete contact with the electrical pin contacts on the machine.

The present design permits subsystem insertion in a main machine by motion in one direction as well as motion in a second direction perpendicular to the first direction. It also provides a simple relatively inexpensive electrical connector with a very small number of parts which is capable of robotic top down assembly. In addition, it is space efficient and provides a matrix of electrical contacts in a variety of configurations. The unique design of the dimple in the spade area of the connecting terminal permits the use male and female portions of quick connect/disconnect of connectors. Further, the design permits access to the mating harness from the rear of the connector which is a more efficient use of space than providing perimeter access to the connector. Furthermore, the connector matrix can be expanded in any direction.

While the invention has been described in detail with reference to specific and preferred embodiments it will be appreciated that various modifications and variations will be apparent to the artisan. All such modifications and embodiments as may readily occur to one skilled in the art are intended to be within the scope of the appended claims.

I claim:

1. An electrical connector assembly having a front and a back view comprising an electrically insulating connector housing having a front side and a back side and at least one aperture therein extending from said front side to said back side, an electrically conductive unitary spring clip connector extending from the front side of said housing through said aperture to the back side of said housing, said spring clip connector having a connecting terminal on one end and a resiliently deflectable spring contact on the other end and an insulating retention plate to retain said spring clip connector in said housing, said retention plate being fastened to and on the back side of said connector housing and having at least one aperture therein with the connecting terminal on one end of said spring clip connector extending therethrough said assembly including a mating and locating feature comprising at least one mounting pin adjacent said at least one aperture in said housing, a mounting hole in said spring clip connector and at least one retention hole in said retention plate, said spring clip being mounted on said mounting pin through said mounting hole and said retention plate being mounted on the top of said spring clip on said mounting pin.

2. The connector assembly of claim 1 wherein said spring clip connector is generally U-shaped with the spring contact being one arm of the U and the mounting hole being in the other arm of the U with the connecting terminal which has a downwardly inclined arm with a male quick connect/disconnect connector at the end.

3. The connector assembly of claim 1 wherein said connecting terminal on said spring clip connector is a male quick connect/disconnect connector having a raised dimple for cooperative engagement with a female quick connect/disconnect connector.

4. The connector assembly of claim 3 wherein the ends of said male connector are rounded.

5. The connector assembly of claim 1 wherein said spring clip connector is stainless steel.

6. The connector assembly of claim 5 wherein said spring clip connector is about 0.2 mm in thickness.

7. The connector assembly of claim 1 wherein there are a plurality of apertures in said housing having cooperatively associated therewith unitary spring clip connectors and apertures in said retention plate to form a plurality of electrical connectors on said front and back sides.

8. The connector assembly of claim 7 wherein said plurality of electrical connectors are in a matrix pattern.

9. The connector assembly of claim 7 wherein all the spring clip connectors are oriented in the same direction.

10. The connector assembly of claim 7 wherein said connecting terminals on said spring clip connectors are male connectors having a raised dimple for cooperative engagement with female connectors.

11. The connector assembly of claim 7 wherein the ends of said male connectors are rounded.

12. The connector assembly of claim 7 wherein all the spring clip connectors are oriented in the same direction.

13. The connector assembly of claim 7 wherein said plurality of electrical connectors on said front and back sides are electrically insulated from each other.

14. The connector assembly of claim 13 wherein said connector housing and retention plate are molded insulating plastic and said connector housing is integrally molded with insulating ribs on its front side separating and electrically isolating adjacent connectors whereby said spring contacts are located in insulating cavities.

15. The connector assembly of claim 13 further including at least one external mounting post to mount said connector assembly to a machine or part thereof.

16. The connector assembly of claim 7 further including mating and locating features comprising mounting pins adjacent each aperture in said housing, mounting holes in each spring clip connector and retention holes in said retention plate, said spring clips being mounted on said mounting pins through said mounting holes and said retention plates being mounted on the top of said spring clips on said mounting pins.

17. The connector assembly of claim 16 wherein each spring clip connector is generally U-shaped with the spring contact being one arm of the U and the mounting hole being in the other arm of the U with the connecting terminal which has a downwardly inclined arm with a male quick connect/disconnect connector at the end.

18. The connector assembly of claim 1 wherein said spring clip connector is stainless steel.

19. The connector assembly of claim 18 wherein said spring clip connector is about 0.2 mm in thickness.

* * * * *